US007775275B2

(12) United States Patent
Patel

(10) Patent No.: US 7,775,275 B2
(45) **Date of Patent: *Aug. 17, 2010**

(54) PROVIDING A STRING HAVING AN ELECTRIC PUMP AND AN INDUCTIVE COUPLER

(75) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 490 days.

This patent is subject to a terminal disclaimer.

(21) Appl. No.: 11/746,967

(22) Filed: May 10, 2007

(65) Prior Publication Data

US 2007/0295504 A1 Dec. 27, 2007

Related U.S. Application Data

(60) Provisional application No. 60/805,691, filed on Jun. 23, 2006.

(51) Int. Cl.
*E21B 43/00* (2006.01)

(52) U.S. Cl. ..... 166/263; 166/66; 166/242.6; 166/105

(58) Field of Classification Search ..... 166/263, 166/369, 373, 386, 378, 66, 105, 242.6
See application file for complete search history.

(56) References Cited

U.S. PATENT DOCUMENTS 6,328,111 B1 12/2001 Bearden
6,354,378 B1 3/2002 Patel
6,360,820 B1 3/2002 Laborde
6,702,015 B2 3/2004 Fielder, III
6,989,764 B2 1/2006 Thomeer
7,093,661 B2 8/2006 Olsen
7,240,739 B2 7/2007 Schoonderbeek
2004/0094303 A1* 5/2004 Brockman et al. ..... 166/313
2005/0092501 A1* 5/2005 Chavers et al. ..... 166/386

FOREIGN PATENT DOCUMENTS

GB 2337780 A 12/1999
GB 2381281 A 4/2003
GB 2436579 A 10/2007
WO 01/98632 A1 12/2001

* cited by examiner

*Primary Examiner*—William P Neuder
*Assistant Examiner*—David Andrews
(74) *Attorney, Agent, or Firm*—Trop, Pruner & Hu, P.C.; Brandon S. Clark; Rodney V. Warfford

(57) ABSTRACT

A system for use in a well includes a string for placement in the well, where the string including an electric pump and a first inductive coupler portion. A completion section is deployed in a zone of the well to be developed, where the completion section includes a second inductive coupler portion for inductive coupling to the first inductive coupler portion. An electrical device is electrically connected to the second inductive coupler portion.

25 Claims, 7 Drawing Sheets

PROVIDING A STRING HAVING AN ELECTRIC PUMP AND AN INDUCTIVE COUPLER

CROSS-REFERENCE TO RELATED APPLICATIONS

This claims the benefit under 35 U.S.C. §119(e) of U.S. Ser. No. 60/805,691, entitled "Sand Face Measurement System and Re-Closeable Formation Isolation Valve in ESP Completion," filed Jun. 23, 2006, which is hereby incorporated by reference.

TECHNICAL FIELD

The invention relates generally to a system for use in a well that includes a string having an electric pump and a first inductive coupler portion, a completion section having a second inductive coupler portion to inductively couple to the first inductive coupler portion, and an electrical device electrically connected to the second inductive coupler portion.

BACKGROUND

A completion system is installed in a well to produce hydrocarbons (or other types of fluids) from reservoir(s) adjacent the well, or to inject fluids into the reservoir(s) through the well. In some completion systems, electric pumps (such as electric submersible pumps or ESPs) are provided. ESPs are typically used for artificial lifting of fluid from a well or reservoir.

To perform workover operations with respect to an ESP, such as to repair the ESP, an upper completion section of the completion system has to be removed. To prevent flow of fluids when the upper completion section is removed, the well is typically killed with a heavy fluid or kill pills to control the well when the upper completion section is pulled out of the well. Alternatively, a formation isolation valve can be provided to isolate a reservoir when the upper completion section is pulled out.

Presence of an ESP in a completion system presents various issues due to not having through bore access for performing intervention below the ESP. A first issue involves the ability to efficiently and safely actuate a valve or other control devices. Another issue involves the ability to efficiently collect measurement data from sensors regarding well characteristics (such as pressure and/or temperature) when the ESP is present. Conventional techniques of obtaining measurement data regarding well characteristics typically involve running an intervention tool into the well. Running an intervention tool can be expensive, particularly in subsea well applications.

SUMMARY OF THE INVENTION

In general, according to an embodiment, a system for use in a well includes a string for placement in the well, where the string includes an electric pump and a first inductive coupler portion. The system further includes a completion section for deployment in a zone of the well to be developed, where the completion section includes a second inductive coupler portion for inductive coupling to the first inductive coupler portion. The completion section also includes an electrical device electrically connected to the second inductive coupler portion.

Other or alternative features will become apparent from the following description, from the drawings, and from the claims.

DETAILED DESCRIPTION

Figure 1:
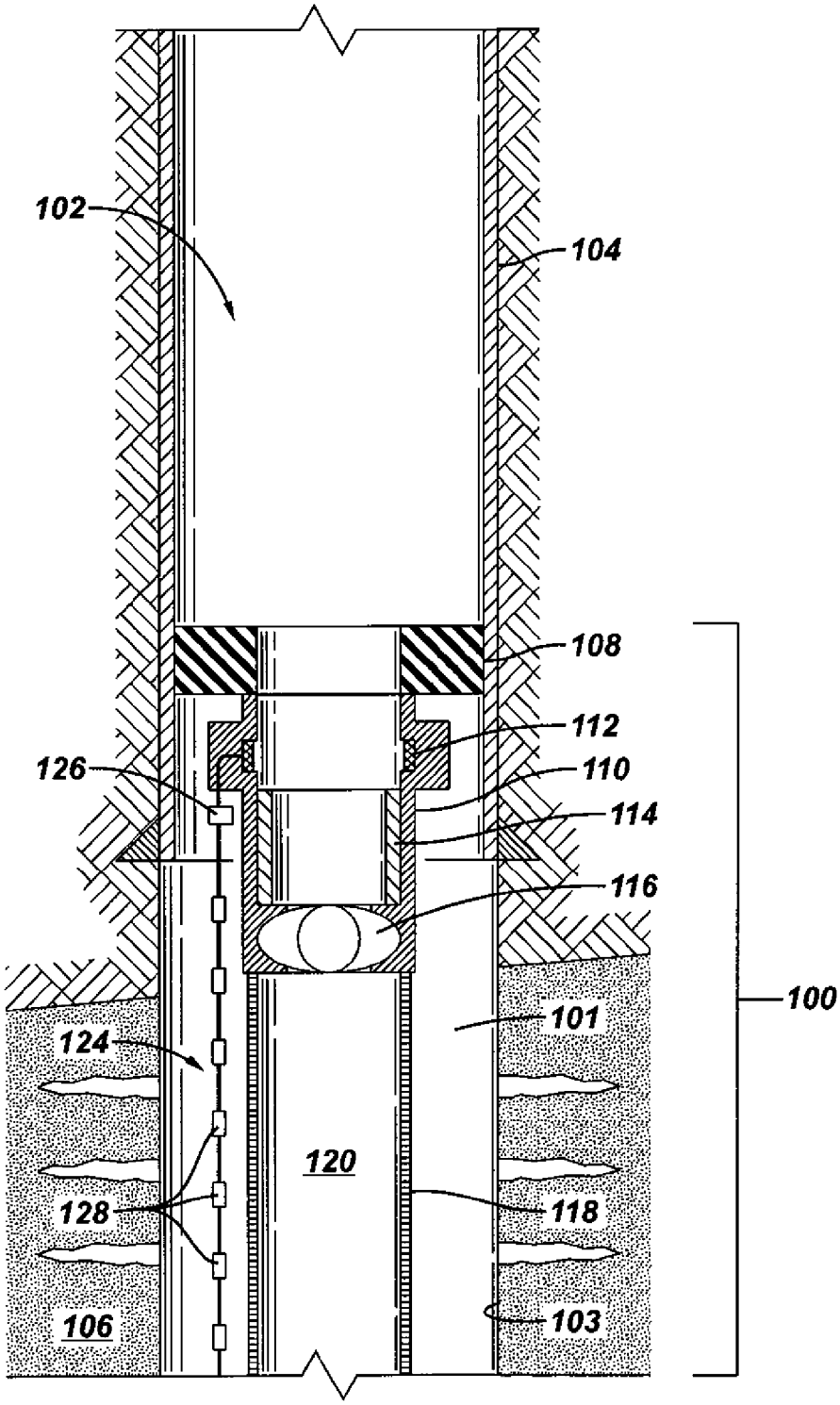
FIGS. 1, 2, and 4 illustrate embodiments of a lower completion section that includes a sensor assembly.

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

In accordance with some embodiments, a string (e.g., a production string or an injection string) that includes an electric pump, such as an electric submersible pump (ESP), is deployed in a well. An electric pump is a pump for transferring fluid in a well, where the pump is activated using a signal, which can be an electrical signal, an optical signal, or other type of signal. The electric pump is powered either by a power source located at an earth surface (from which the well extends), or by a local, downhole power source. In the production context, the ESP is used to perform artificial lift to aid the production of fluids (e.g., hydrocarbons) from a reservoir (or reservoirs) to an earth surface through the well.

The production or injection string includes the electric pump as well as a first inductive coupler portion that is electrically connected to an electric cable that extends to another location in the well or to an earth surface location. The electric cable to which the first inductive coupler portion is electrically connected can be the electric cable to the electric pump (hereinafter "pump cable"), or alternatively, the electric cable can be separate from the pump cable.

The first inductive coupler portion enables communication of power and data to one or more electrical devices that are part of a lower completion section in which the production or injection string is engaged. The production or injection string and the lower completion section effectively make up a two-stage completion system. The lower completion section further includes a second inductive coupler portion that is placed adjacent the first inductive coupler portion when the production or injection string is engaged with the lower completion section. The first and second inductive coupler portions, which form an inductive coupler, are able to inductively couple power and data between the production or injection string and the lower completion section.

The inductive coupler portions perform communication using induction. Induction is used to indicate transference of a time-changing electromagnetic signal or power that does not rely upon a closed electrical circuit but instead includes a component that is wireless. For example, if a time-changing current is passed through a coil, then a consequence of the time variation is that an electromagnetic field will be generated in the medium surrounding the coil. If a second coil is placed into that electromagnetic field, then a voltage will be generated on that second coil, which we refer to as the induced voltage. The efficiency of this inductive coupling increases as the coils are placed closer, but this is not a necessary constraint. For example, if time-changing current is passed through a coil is wrapped around a metallic mandrel, then a voltage will be induced on a coil wrapped around that same mandrel at some distance displaced from the first coil. In this way, a single transmitter can be used to power or communicate with multiple sensors along the wellbore. Given enough power, the transmission distance can be very large. For example, solenoid coils on the surface of the earth can be used to inductively communicate with subterranean coils deep within a wellbore. Also note that the coils do not have to be wrapped as solenoids. Another example of inductive coupling occurs when a coil is wrapped as a toroid around a metal mandrel, and a voltage is induced on a second toroid some distance removed from the first.

Examples of electrical devices that can be part of the lower completion section include sensors, valves to control communication of fluid, and/or other electrical devices. Through the inductive coupler, measurement data from sensors in the lower completion section can be communicated to the production string electric cable. The measurement data can be routed over the production string electric cable to a surface controller at an earth surface location or a downhole controller at a downhole location. Also, commands can be provided over the electric cable of the production string to control an electric device in the lower completion section, such as a valve. An example of such a valve is a formation isolation valve, which when closed is used to isolate a zone or reservoir of the well so that an upper part of the completion system, such as the production/injection string, can be removed from the well.

Power on the electric cable of the production string can also be provided to the electrical device(s) of the lower completion section through the inductive coupler. The power can originate from an energy source at the earth surface, or from an energy source that is part of the production string. Examples of energy sources include batteries, power supplies, and so forth.

In another embodiment, a downhole power generator can be used for supplying power to sensors and electrical devices, and wireless telemetry (e.g., acoustic telemetry) between lower and upper completions can be used in place of the inductive coupler.

In other embodiments, inductive couplers can be omitted such that communication with and control of downhole electric devices are accomplished using a different mechanism.

According to some embodiments of the invention, the communication of data and/or power with electrical devices can be accomplished in an interventionless manner, even though a production or injection string includes an electric pump. "Interventionless" communication refers to communication that does not require a separate tool (referred to as an intervention tool) to be run into the well. The ability to perform interventionless communication with electrical devices in a completion system that also includes an electric pump allows for more efficient operation of a well (either a land well or a subsea well).

In the discussion below, reference is made to completion systems for producing fluids from wells. Note that the techniques discussed below can also be applied to injection systems, with which fluids (liquids or gases) can be injected into the well to a surrounding reservoir (or reservoirs).

FIG. 1 illustrates one embodiment of a lower completion section 100 that is deployed in a well 102 having a portion lined with casing 104. The lower completion section 100 is positioned proximate a reservoir 106 from which fluids, such as hydrocarbons, are to be produced. The reservoir 106 is part of a well zone to be developed, in this case, produced. In the injection context, development of a zone refers to injection of fluids into the reservoir.

The portion of the well 102 that extends through the reservoir 106 is un-lined (in other words, the lower completion section 100 is at least partly deployed in an open hole section of the well 102). In an alternative implementation, the lower completion section 100 can be positioned in a zone that is lined with a casing 104 (or with another type of liner), with perforations formed in the casing or other liner to allow communication of fluids between the surrounding reservoir and the well 102.

As depicted in FIG. 1, the lower completion section 100 includes a packer 108. Below the packer 108 is a housing section 110. An inductive coupler portion 112 (e.g., a female inductive coupler portion) is part of the housing section 110.

A formation isolation valve 116 is attached to the housing 110. A valve operator 114 is attached to the formation isolation valve 116, where the valve operator 114 is for operating (opening or closing) the formation isolation valve 116. In FIG. 1, the formation isolation valve 116 is implemented with a ball valve. In other implementations, the formation isolation valve 116 can be implemented with other types of valves, such as sleeve valves, disk valves, one way sealing flapper valves, two way sealing flapper valves, and so forth. As depicted in FIG. 1, when the valve 116 is closed, the reservoir 106 is isolated from the part of the well 102 above the lower completion section 100, so that fluids from the reservoir 106 cannot flow into the well 102 above the lower completion section 100 or the fluid in the casing annulus 102 does not flow into reservoir formation 106. However, when the formation isolation valve 116 is opened, reservoir fluids can pass from an annulus region 101 through a sand control assembly 118, or a perforated pipe, or a slotted pipe that is part of the lower completion section 100 into an inner bore 120 of the lower completion section 100. The annulus region 101 is defined between the sand control assembly 118 and a sand face 103 of the well. The fluids flow upwardly through the open formation isolation valve 116 to a production string (shown in FIG. 3) that is located above the lower completion section 100. Examples of the sand control assembly 118 include a sand screen, a slotted or perforated liner, or a slotted or perforated pipe. Gravel is packed around the sand control assembly 118 such that the combination of the sand control assembly 118 and the gravel pack is able to filter particulates, such as sand, from production fluids.

In the embodiment of FIG. 1, the valve operator 114 is mechanically connected to the formation isolation valve 116 (which is a mechanical formation isolation valve) to operate the valve 116. For example, the valve operator 114 can include a shiftable mandrel that is shifted to a first position to open the formation isolation valve 116, and to a second position to close the formation isolation valve 116. As discussed further below in connection with FIG. 3, the valve operator 114 is actuated by an electronic and motor module that is part of the production string.

The lower completion section 100 also includes a sensor assembly 124 that is electrically connected through a controller cartridge 126 to the inductive coupler portion 112. The controller cartridge 126 is able to receive commands from another location (such as at the earth surface or from another location in the well). These commands can instruct the controller cartridge 126 to cause sensors 128 of the sensor assembly 124 to take measurements. Example parameters that can be measured include temperature, pressure, flow rate, fluid density, reservoir resistivity, oil/gas/water ratio, viscosity, carbon/oxygen ratio, acoustic parameters, characteristics subject to chemical sensing (such as for scale, wax, asphaltenes, deposition, pH sensing, salinity sensing), and so forth. Also, the controller cartridge 126 is able to store and communicate measurement data from the sensors 128. Thus, at periodic intervals, or in response to commands, the controller cartridge 126 is able to communicate the measurement data to another component. Generally, the controller cartridge 126 includes a processor and storage.

The sensor assembly 124 can be implemented with a sensor cable (also referred to as a sensor bridle). The sensor cable is basically a continuous control line having portions in which sensors are provided. The sensor cable is "continuous" in the sense that the sensor cable provides a continuous seal against fluids, such as wellbore fluids, along its length. Note that in some embodiments, the continuous sensor cable can actually have discrete housing sections that are sealably attached together (such as by welding). In other embodiments, the sensor cable can be implemented with an integrated, continuous housing without breaks. Further details regarding sensor cables are described in U.S. Ser. No. 11/688,089, entitled "Completion System Having a Sand Control Assembly, an Inductive Coupler, and a Sensor Proximate the Sand Control Assembly," filed Mar. 19, 2007, now U.S. Patent Publication No. 2007/0227727, which is hereby incorporated by reference.

Figure 2:
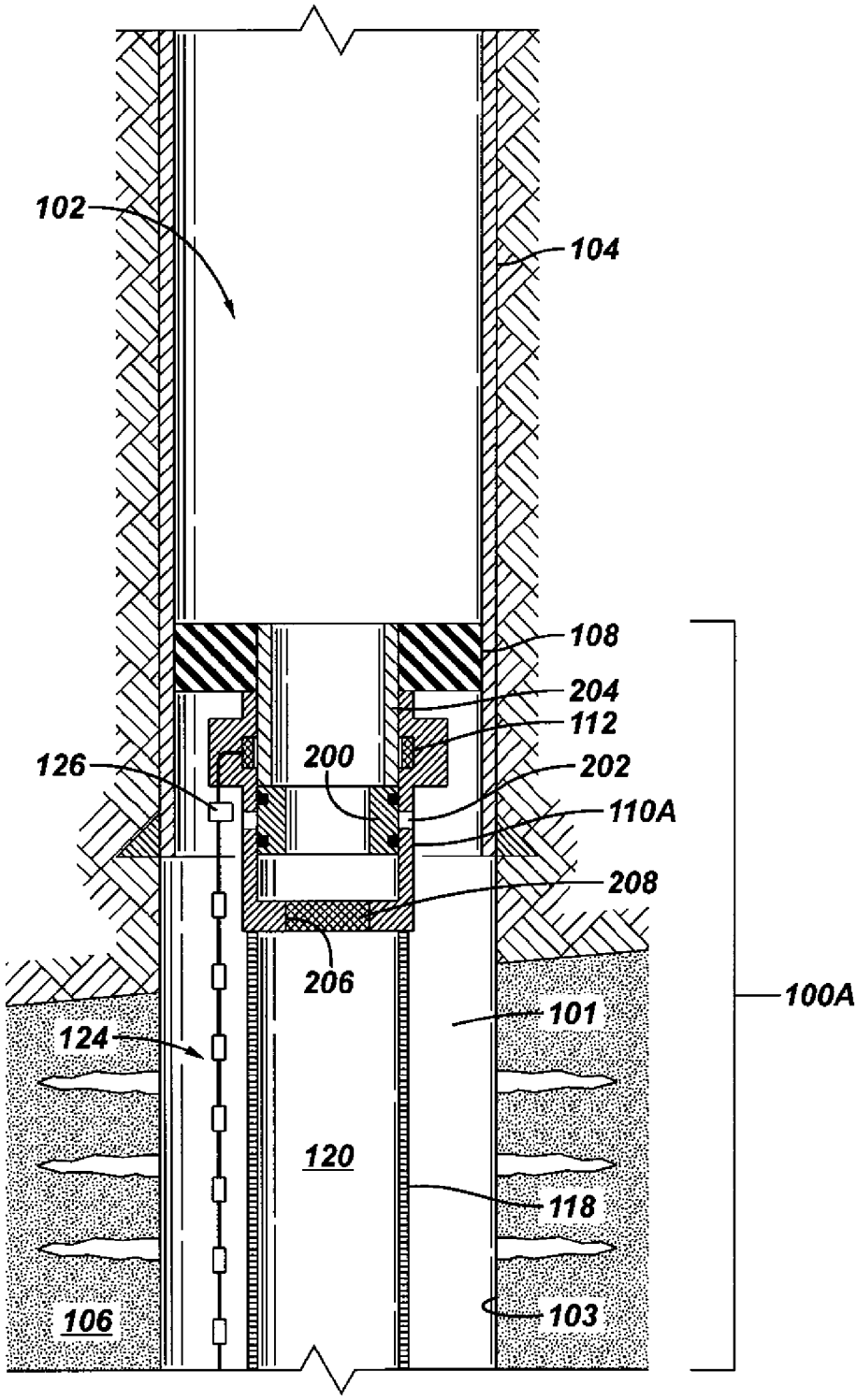

FIG. 2 illustrates a variant of the lower completion section of FIG. 1. The lower completion section of FIG. 2 is referenced as 100A. The difference between the lower completion section 100A of FIG. 2 and the lower completion section 100 of FIG. 1 is that a formation isolation valve 200 in the FIG. 2 embodiment is implemented with a sliding sleeve valve rather than the ball valve 116 that is depicted in FIG. 1. The sliding sleeve valve 200 is slidable in the longitudinal direction of the well 102. The sliding sleeve valve 200 is slidable between an open position and a closed position with respect to one or more ports 202 that are defined in a housing section 110A that extends downwardly from the packer 108. The sliding sleeve valve 200 is operatively connected to a valve operator 204, which can also be actuated by an electronic and motor module (discussed further below). The valve operator 204 is shiftable to cause the sliding sleeve valve 200 to move between an open position and a closed position.

The lower completion section 100A also includes the sensor assembly 124, controller cartridge 126, and inductive coupler portion 112, similar to the embodiment of FIG. 1.

The housing section 202 further defines an opening 206 at its lower end. In FIG. 2, the opening 206 is plugged with a plug 208. With the plug 208 in place, any flow between the annulus region 101 (that is defined between the sand control assembly 118 and the sand face 103 of the well 102) occurs through the sliding sleeve valve 200. Note that the plug 208 is a retrievable plug that can be removed to allow communication of well fluids through the lower opening 206 of the housing section 110A. Also, note that the opening 206 is aligned with the inner bore 120 in the longitudinal direction such that a tool can pass through the opening 206 to a section of the well below the formation isolation valve 200. In an alternate embodiment, the plug 206 can be replaced with a mechanical formation isolation valve having a ball valve or a disc valve or a flapper valve to allow access to the lower completion region 120 without the need for a trip to retrieve the plug.

Figure 3:
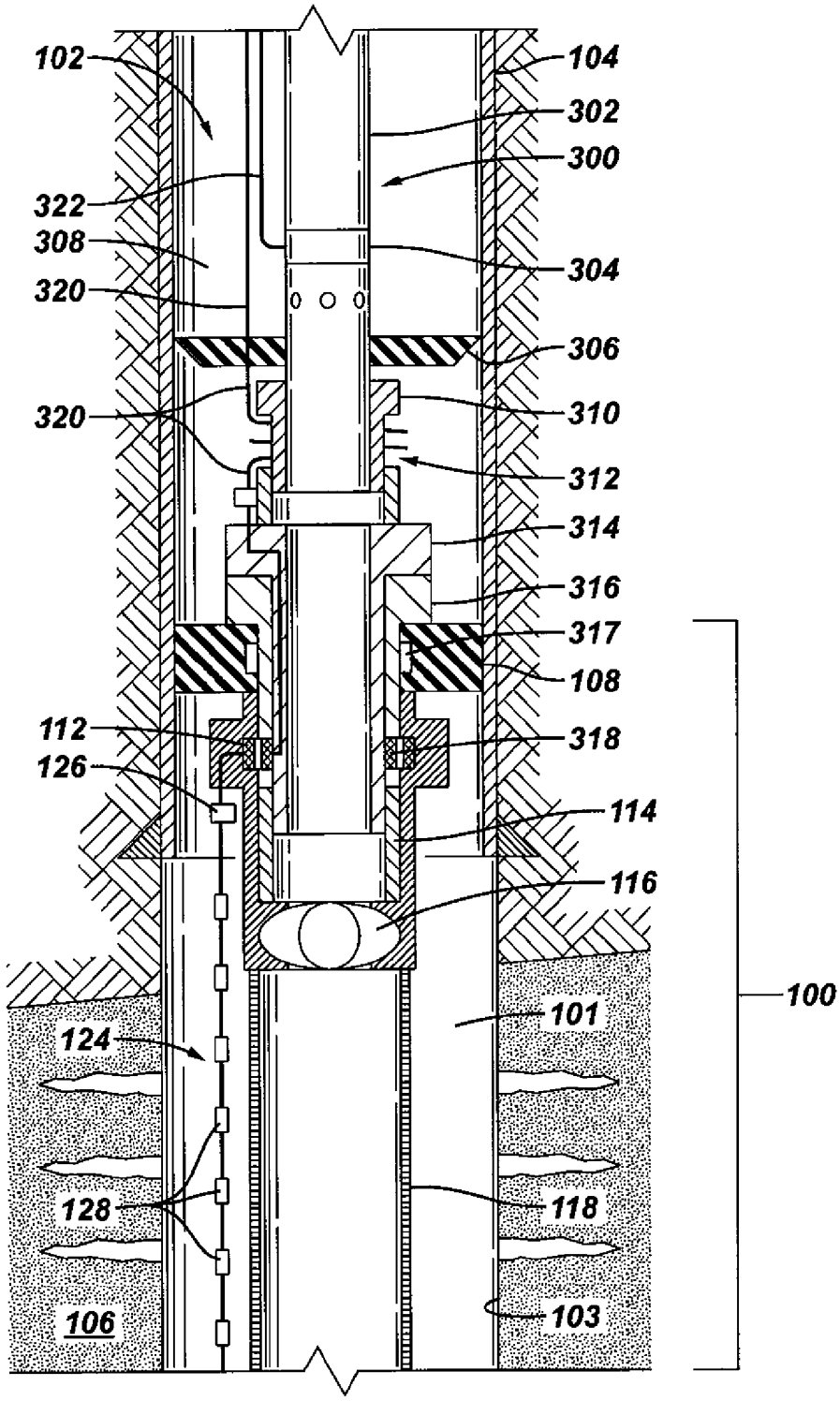
FIG. 3 illustrates a completion system having a production string that is engaged in the lower completion section of FIG. 1, where the production string includes an electric submersible pump (ESP).

FIG. 3 shows deployment of a production string 300 that includes a tubing 302 and an electric submersible pump (ESP) 304 in the well 102. The production string 300 is engaged with the lower completion section 100 of FIG. 1. Together, the production string 300 and the lower completion section 100 make up a two-stage completion system. As depicted in FIG. 3, the production string 300 further includes a cup packer 306 that acts as a debris barrier to prevent debris in the lower part of the well 102 from entering an annulus region 308 that is above the cup packer 306 and that is defined between the outer surface of the tubing 302 and the inner surface of the casing 104. In some embodiments, the cup packer is not run. In another embodiment, a completion packer is run above the ESP pump.

The production string 300 also has a subsurface safety valve 310 (which is optional) that closes in the event of an emergency to shut-in the well 102. The production string 300 further includes a contraction joint 312 (which is optional) that is provided to adjust the longitudinal length of the production string that is set on the packer 108. Note that the production string 300 is deployed between the packer 108 and a tubing hanger (not shown) located at the earth surface. The production string 300 is engaged with the lower completion section by use of a snap latch mechanism 317 (or by some other type of engagement mechanism).

The production string 300 also includes an operator module, e.g., electronic and motor module 314 and a control station 316. The operator module may be an electrical, electro-hydraulic, hydraulic or any other mechanism for operating the formation isolation valve. The control station 316 includes a processor, storage devices, and optionally, sensors (e.g., temperature and/or pressure sensors). The control station 316 further includes a telemetry module to perform communication with a surface controller located at the earth surface or with another downhole controller.

The electronic and motor module 314 includes components to actuate the valve operator 114. The electronic and motor module 314 mechanically engages the valve operator 114 to shift the valve operator 114 between different positions to actuate the formation isolation valve 116. In some implementations, the electronic and motor module 314 includes a motor to operate the valve operator 114. The electronic and motor module 314 is electrically connected to an electric cable 320, which extends upwardly from the electronic and motor module 314 to the contraction joint 312. At the contraction joint 312, the electric cable 320 can be wound in a spiral fashion until the electric cable 320 to provide a helically wound cable. From the upper end of the contraction joint 312, the electric cable 320 further passes upwardly through the cup packer 306 to the annulus region 308 above the cup packer 306. The electric cable 320 can extend to the earth surface, or to another location downhole. Also depicted in FIG. 3 is a second electric cable 322 that is connected to the ESP 304. The second electric cable 322 is referred to as the "pump cable." The pump cable 322 supplies power and commands to electrically operate the ESP 304.

The control station 316 is electrically connected to an inductive coupler portion 318 (which is attached to a lower part of the production tubing 300). The inductive coupler portion 318 can be a male inductive coupler portion that is engageable within the female inductive coupler portion 112 of the lower completion section 100. When positioned next to each other, the inductive coupler portions 112, 318 are able to perform power and data communication by inductive coupling. Measurement data collected by the sensor assembly 124 is communicated through the inductive coupler formed with inductive coupler portions 112 and 318 to the control station 316.

The control station 316 is also electrically connected to the electric cable 320 to allow the electric cable 320 to communicate with another component (e.g., a surface controller or a downhole controller).

In an alternative implementation, instead of using two separate electric cables 320,322 to separately connect to the ESP 304 and the electronic and motor module 314 and control station 316, the same electric cable can be run to both the ESP 304 and to module 314 and control station 316.

In operation, the lower completion section 100 is first run into the well 102 to a depth adjacent the reservoir 106 to be produced. The packer 108 of the lower completion section 100 is then set to fix the position of the lower completion section 100 and to provide a fluid seal. Next, a gravel packing operation has been performed to gravel pack the annulus region 101 between the sand control assembly 118 and the sand face 103 if sand control is required.

After gravel packing, the production string 300 is run into the well 102 and engaged with the lower completion section 100 using the snap latch mechanism 317. Once the production string 300 and lower completion section 100 are engaged, production of fluids can begin.

In the operations discussed above, the formation isolation valve 116 can be actuated between open and closed positions by using electrical commands sent over the electric cable 320 to the electronic and motor module 314. The control station 314 can be instructed to collect measurement data from the sensor assembly 124 and to send the measurement data to a surface controller or another downhole controller. The ESP 304 can be activated to start fluid pumping operation to lift production fluids in the production tubing 302.

Figure 4:
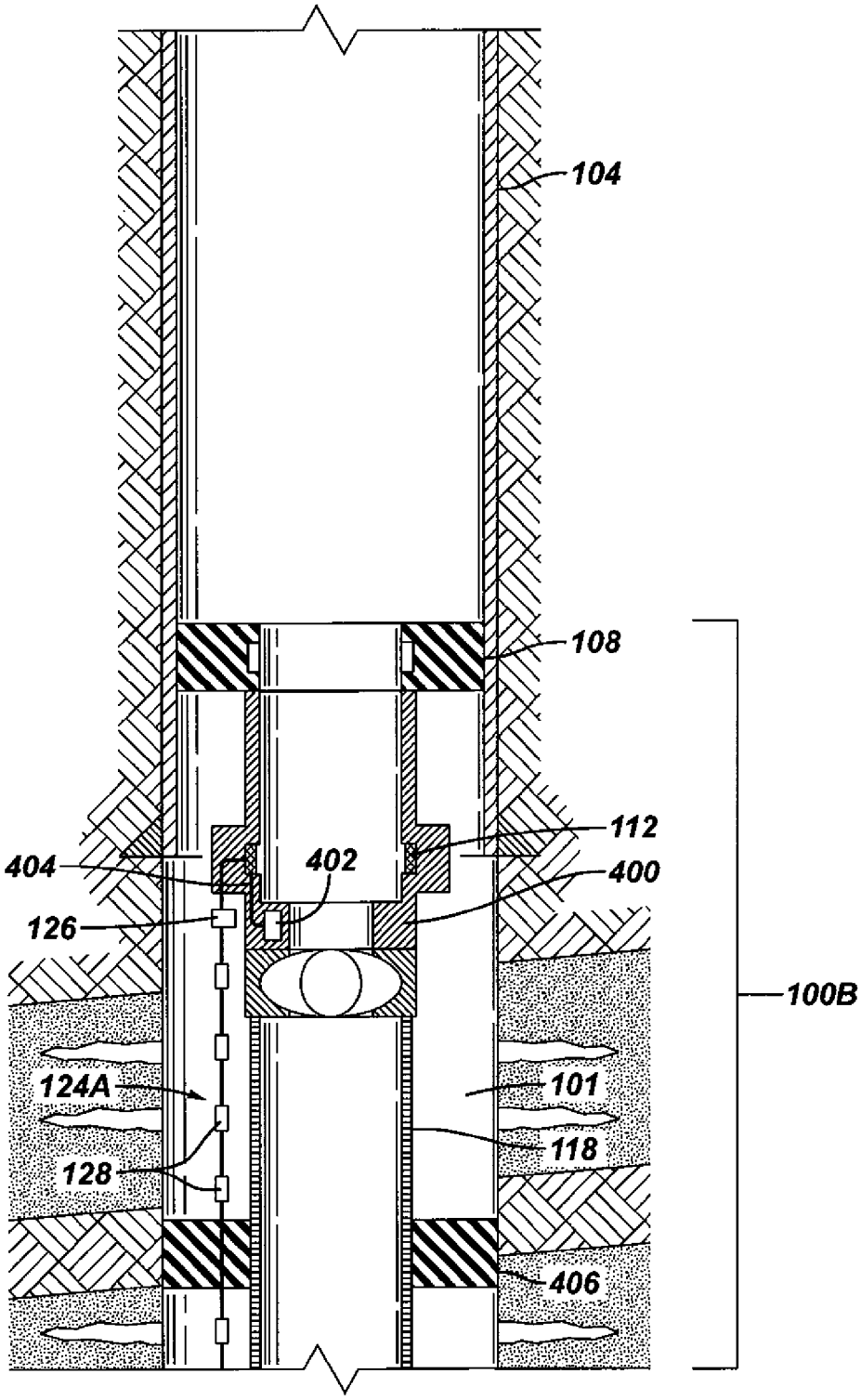

FIG. 4 illustrates an alternative embodiment of a lower completion section, identified as 100B. The lower completion section 100B includes an electric formation isolation valve 400 (rather than the mechanical formation isolation valves 116 and 200 of FIGS. 1 and 2). The electric formation isolation valve 400 is operated using electric power supplied by electric cable. The electric formation isolation valve 400 can include an energy source 402. The energy source 402 is connected by an electrical conductor 404 to the inductive coupler portion 112 that is part of the lower completion section 100B.

The energy source 402 of the electric formation isolation valve 400 can be implemented as a capacitor in a one embodiment. The capacitor can be trickle-charged by power communicated through the inductive coupler portion 112 to contain sufficient electrical charge to power the actuation of the formation isolation valve. In an alternative implementation, instead of using a capacitor as the energy source 402, the energy source can instead be implemented with a battery. In yet another embodiment, power to the formation isolation valve 400 can be provided from an energy source that is part of a production string (not shown in FIG. 4) or by a power source at the earth surface. This power is communicated through an electric cable to a mating inductive coupler portion that is positioned proximate the inductive coupler portion 112 of FIG. 4.

The energy source 402 is used to power actuation components of the electric formation isolation valve 400 to open or close the valve. Such actuation is controlled using commands communicated over the electric cable 320 (see FIG. 5).

The lower completion section 100B also differs from the lower completion section 100 of FIG. 1 in that an isolation packer 406 is provided in the annulus region 101 outside the sand control assembly 118. The isolation packer 406 is able to isolate the annulus region 101 into two zones (one zone above the isolation packer 406 and another zone below the isolation packer 406).

The lower completion section 100B also includes a sensor cable 124A that extends through the isolation packer 406 such that sensors 128 are provided in each of the zones. The sensor cable 124A is electrically connected through the controller cartridge 126 to the inductive coupler portion 112.

Figure 5:
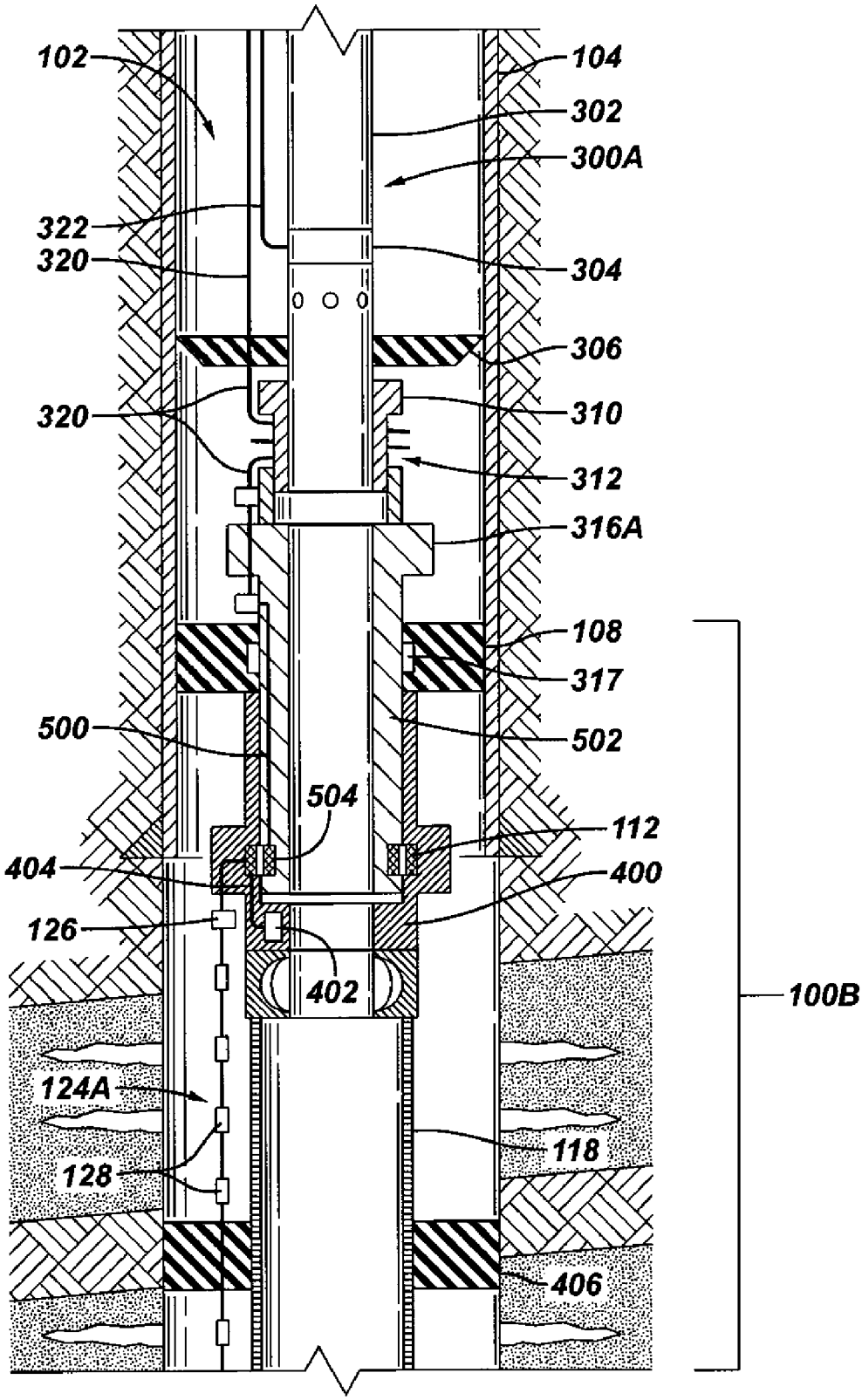
FIG. 5 illustrates another completion system having a production string that is engaged in the lower completion section of FIG. 4, where the production string includes an ESP.

FIG. 5 shows a production string 300A engaged with the lower completion section 100B of FIG. 4. The production string 300A of FIG. 5 is different from the production string 300 of FIG. 3 in that the production string 300A does not include an electronic and motor module 314 that is part of the production string 300 of FIG. 3.

As depicted in FIG. 5, a control station 316A (which is part of the production string 300A) is electrically connected over electrical conductor(s) 500 that is (are) embedded within housing section 502 of the production string 300A. The electrical conductors) 500 is (are) electrically connected to a male inductive coupler portion 504 that is part of the housing section 502 of the production string 300A. The male inductive coupler portion 504 is positioned adjacent the female inductive coupler portion 112 to enable communication of power and data with the sensor cable 124A and the electric formation isolation valve 400.

In operation, the control station 316A can be instructed (such as by a surface controller) over the electric cable 320 to send commands to the electric formation isolation valve 400 to actuate the formation isolation valve 400 between an open position and a closed position. Also, the control station 316A is able to collect measurement data from the sensor cable 124A, and to transmit such measurement data over the electric cable 320.

In a variation of the embodiment of FIGS. 4 and 5, instead of using inductive coupler portions 112 and 504, wireless telemetry (e.g., acoustic telemetry) can be used instead. In such implementation, the telemetry element 112 is able to communicate wirelessly (e.g., with acoustic signals) with either corresponding telemetry element 504 or with a telemetry element at the earth surface. In this implementation, the energy source 402 is a downhole power generator that is capable of supplying power for operating the valve 400 in response to commands communicated wirelessly (e.g., with acoustic signals).

Figure 6:
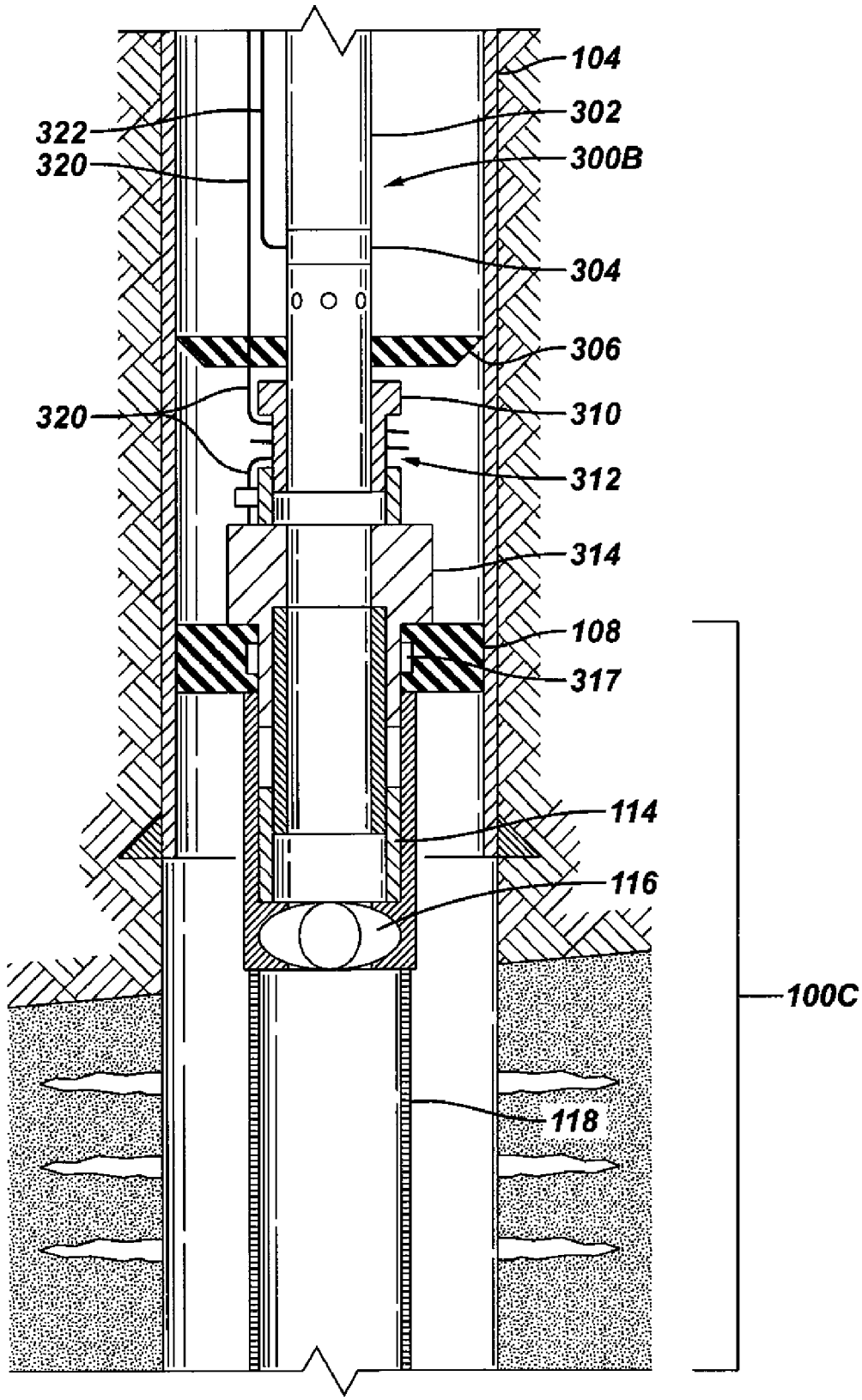
FIG. 6 illustrates another completion system having a production string that is engaged in a lower completion section having another arrangement, where the production string includes an ESP.

FIG. 6 shows a variant of the embodiment of FIG. 3. In the FIG. 6 variant, a lower completion section 100C does not include the sensor cable 124 and the controller cartridge 126 of FIG. 1. Also, no inductive coupler portions are included in the lower completion section 100C and a production string 300B that is engaged with the lower completion section 100C. In the FIG. 6 embodiment, the mechanical formation isolation valve 116 is operated by the electronic and motor module 314 (in a manner similar to the FIG. 3 embodiment).

Figure 7:
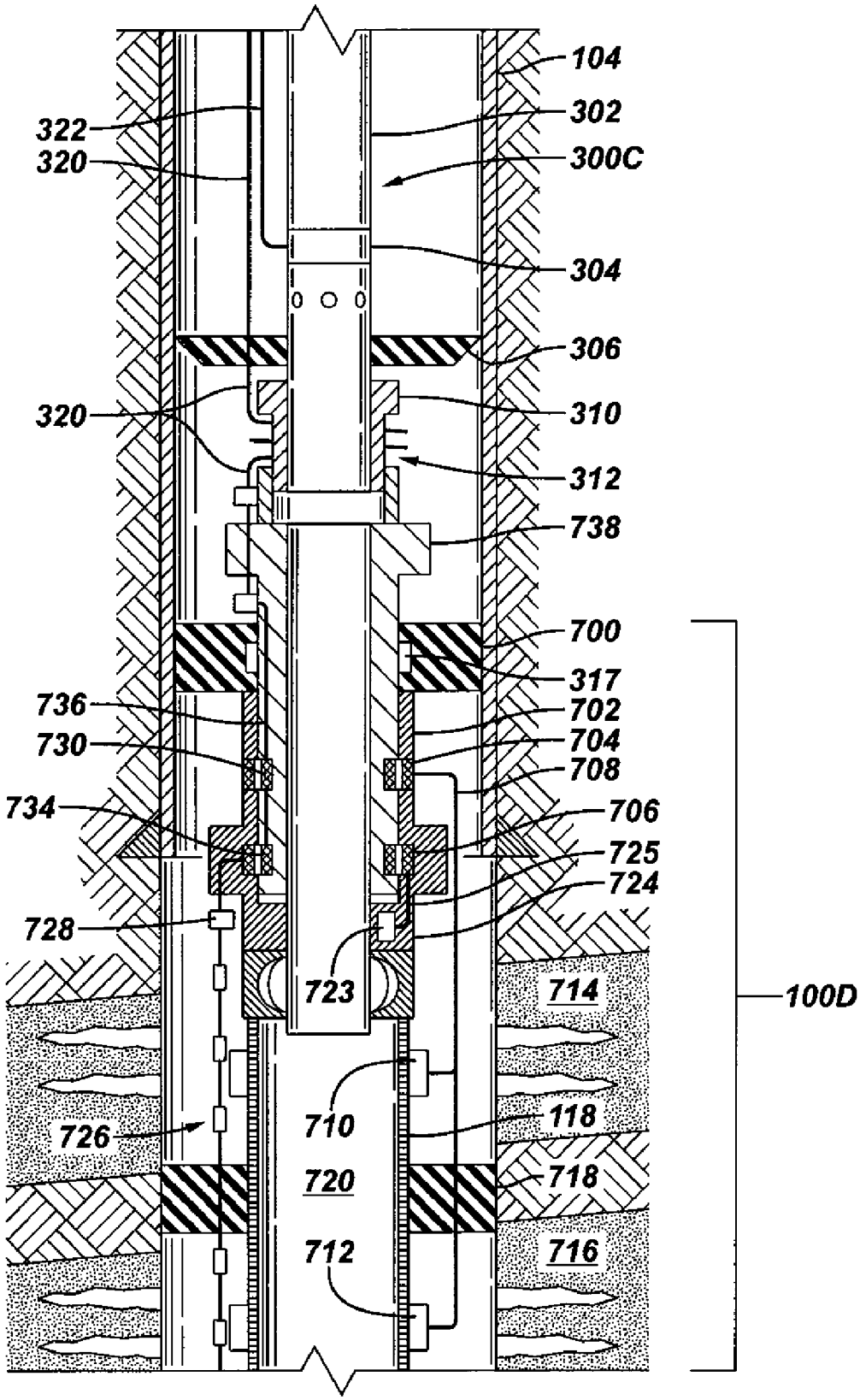
FIG. 7 illustrates yet another completion system having a production string that is engaged in a lower completion section having yet another arrangement, where the production string includes an ESP.

FIG. 7 is a different embodiment of a two-stage completion system that includes a production string 300C and a lower completion section 100D. The lower completion section 100D has a packer 700 and a housing section 702 below the packer 700. The housing section 702 has two female inductive coupler portions 704, 706, where the first female inductive coupler portion 704 is electrically connected to an electric cable 708 that extends to flow control valves 710, 712, deployed in zones 714, 716, respectively. The zones 714 and 716 are isolated by an isolation packer 718. The flow control valves 710, 712 control radial fluid flow from the surrounding reservoir into the inner bore 720 of sand control assembly 118.

The second female inductive coupler portion 706 is electrically connected to an electric formation isolation valve 724, which is similar to the electric formation isolation valve 400 of FIG. 4. The electric formation isolation valve 724 includes an energy source 723 and an electrical conductor 725 connecting the energy source 723 to the female inductive coupler portion 706. The female inductive coupler portion 706 is also electrically connected to a sensor cable 726 that extends through the isolation packer 718. The sensor cable 726 is electrically connected to the female inductive coupler portion 706 through a controller cartridge 728.

The production string 300C includes two male inductive coupler portions 730, 734, that are positioned adjacent respective female inductive coupler portions 704, 706. Both the male inductive coupler portions 730, 734 are electrically connected by electric conductor(s) 736 to a control station 738 that is also part of the production string 300B. The remaining components of the production string 300C are similar to the production string 300 or 300A of FIG. 3 or 5.

In another variation of the FIG. 7 embodiment, only one inductive coupler is run. The sensor, flow control valve and formation isolation valve and other electrically actuated devices are all connected to same cable. Also, a mechanical formation isolation valve could be used in place of electrical formation isolation valve.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A system for use in a well, comprising:

a string for placement in the well, the string including an electric pump and a first inductive coupler portion; and a completion section for deployment in a zone of the well to be developed, wherein the completion section and string are configured for separate deployment into the well, wherein the string is configured to be engaged with the completion section after the completion section has been deployed in the zone, and wherein the completion section comprises:

a second inductive coupler portion for inductive coupling to the first inductive coupler portion;

an electrical device electrically connected to the second inductive coupler portion; and a valve actuatable between an open position and a closed position, wherein the string further includes an electrical module to actuate the valve.

2. The system of claim 1, wherein the electrical device comprises a sensor.

3. The system of claim 1, wherein the valve comprises a formation isolation valve.

4. The system of claim 1, wherein the valve comprises a mechanical valve, and wherein the completion section further comprises a valve operator shiftable between positions to open and close the valve, and wherein the electrical module is configured to shift the valve operator.

5. The system of claim 4, wherein the electrical module comprises a motor to shift the valve operator.

6. The system of claim 5, wherein the string further comprises a first electric cable, and wherein the electrical module is electrically activatable by the electric cable.

7. The system of claim 6, wherein the string further comprises a second electric cable electrically connected to the electric pump.

8. The system of claim 6, wherein the first electric cable is further electrically connected to the electric pump.

9. The system of claim 1, wherein the string comprises one of a production string and an injection string.

10. The system of claim 1, wherein the electric pump comprises an electric submersible pump.

11. The system of claim 1, wherein the electrical device comprises a sensor cable having plural sensors.

12. The system of claim 11, wherein the string further comprises a control station to communicate with the sensors through the first and second inductive coupler portions.

13. The system of claim 11, wherein the completion section further comprises an isolation packer to isolate multiple zones in the well, and wherein the sensor cable extends through the isolation packer to provide sensors in the multiple zones.

14. The system of claim 1, wherein the valve is an electric valve having an energy source electrically connected to the second inductive coupler portion.

15. The system of claim 1, wherein the electrical device is a first electrical device, and wherein the string further comprises a third inductive coupler portion, and the completion section further comprises a fourth inductive coupler portion and a second electrical device, the fourth inductive coupler portion being electrically connected to the second electrical device, and the third inductive coupler portion to inductive couple to the fourth inductive coupler portion.

16. The system of claim 15, wherein the first electrical device comprises a sensor cable having plural sensors, and wherein the second electrical device comprises a flow control valve.

17. The system of claim 1, wherein the string further has a control station including a processor and a storage device, and wherein the control station is configured to:

electrically communicate with the electrical device through the first and second inductive coupler portions; and communicate with a surface controller at an earth surface.

18. A method for use in a well, comprising:

installing a first completion section in the well, wherein the first completion section has a valve and an electrical device to perform an action with respect to a zone to be developed;

after installing the first completion section in the well, installing a string in the well so that the string is engaged with the first completion section, wherein the string includes a first electric cable, an electric pump, and an electrical module to actuate the valve;

communicating at least one of power and data between the first electric cable and the electrical device through an inductive coupler; and activating the electric pump to transfer fluid in the well.

19. The method of claim 18, wherein the valve is a formation isolation valve that is closable to isolate the zone in the well.

20. The method of claim 19, wherein the formation isolation valve comprises a mechanical formation isolation valve, and wherein the first completion section further comprises a shiftable valve operator to operate the mechanical formation isolation valve, the method further comprising:

activating the electrical module that is part of the string to actuate the valve operator, wherein the electrical module includes electronic circuitry and a motor.

21. The method of claim 19, wherein the formation isolation valve comprises an electric formation isolation valve that includes an electric operator module.

22. The method of claim 19, wherein the formation isolation valve comprises an electric formation isolation valve that includes an energy source, the method further comprising:

charging the energy source using the inductive coupler, wherein the energy source includes a capacitor, and wherein charging the energy source comprises trickle charging the capacitor.

23. The method of claim 18, wherein installing the string comprises installing the string that further includes a control station having a processor and a storage device, the method further comprising:

the control station electrically communicating with the electrical device through the inductive coupler; and the control station communicating with a surface controller at an earth surface.

24. A system for use in a well, comprising:

a lower completion section having a formation isolation valve and a shiftable valve operator to operate the formation isolation valve; and a string separately deployable into the well after deployment of the lower completion section into the well, wherein the string is engaged with the lower completion section, wherein the string comprises an electric pump, an electrical module, and an electric cable electrically connected to the electrical module, wherein the electrical module is activatable over the electric cable to shift the valve operator.

25. The system of claim 24, wherein the lower completion section further has an electrical device, and the string further has a control station having a processor and a storage device, and wherein the control station is configured to:

electrically communicate with the electrical device through the first and second inductive coupler portions; and communicate with a surface controller at an earth surface.

* * * * *